US008677975B2

(12) United States Patent
Auclair et al.

(10) Patent No.: US 8,677,975 B2
(45) Date of Patent: Mar. 25, 2014

(54) METHOD FOR DETECTION OF ABNORMAL COMBUSTION FOR INTERNAL COMBUSTION ENGINES

(75) Inventors: Dominique Auclair, Villiers-sur-Marne (FR); Laurent Duval, Nanterre (FR); Alexandre Pagot, Rueil-Malmaison (FR); Jean-Marc Zaccardi, Seynod (FR)

(73) Assignee: IFP, Rueil-Malmaison Cedex (FR)

( * ) Notice: Subject to any disclaimer, the term of this patent is extended or adjusted under 35 U.S.C. 154(b) by 1223 days.

(21) Appl. No.: 12/562,339

(22) Filed: Sep. 18, 2009

(65) Prior Publication Data

US 2010/0077992 A1 Apr. 1, 2010

(30) Foreign Application Priority Data

Sep. 18, 2008 (FR) ..... 08 05132

(51) Int. Cl.
*F02M 7/00* (2006.01)

(52) U.S. Cl.
USPC ..... 123/435

(58) Field of Classification Search
USPC ..... 123/434, 435, 479, 585, 630, 406.21, 123/406.29, 406.47, 436, 406.34; 73/35.09; 701/111
See application file for complete search history.

(56) References Cited

U.S. PATENT DOCUMENTS

| | | | | |
|---|---|---|---|---|
| 5,080,068 | A * | 1/1992 | Sawamoto | 123/435 |
| 2007/0215111 | A1* | 9/2007 | Surnilla | 123/431 |
| 2007/0251494 | A1* | 11/2007 | Hashizume et al. | 123/406.41 |
| 2008/0035129 | A1* | 2/2008 | Vangraefschepe et al. | 123/585 |
| 2009/0159046 | A1* | 6/2009 | Moriya | 123/435 |

FOREIGN PATENT DOCUMENTS

| | | | | |
|---|---|---|---|---|
| EP | 1 826 379 | A1 | 8/2007 | |
| GB | 2 244 514 | A | 4/1991 | |
| WO | WO 2006/067333 | A1 | 6/2006 | |
| WO | WO 2007013663 | A1 * | 2/2007 | F02D 35/02 |

* cited by examiner

*Primary Examiner* — Stephen K Cronin
*Assistant Examiner* — Sizo Vilakazi
(74) *Attorney, Agent, or Firm* — Antonelli, Terry, Stout & Kraus, LLP.

(57) ABSTRACT

A method for detection of abnormal combustion for internal combustion engines is disclosed. A physical model is chosen that describes, as a function of the angle α of rotation of the engine crankshaft, the development of pressure in the cylinder during combustion without any pre-ignition phenomenon. The cylinder pressure $P_e(\alpha)$ is estimated using this model and the intake pressure is measured. The beginning of abnormal combustion is detected by comparing a first value of a variable calculated using the measurement of the cylinder pressure, to a second value of the variable calculated using the estimation of the cylinder pressure. The amplitude of the pre-ignition is determined by repeating these steps for a defined number of crankshaft angles. Then the progress of the abnormal combustion detected in the combustion chamber is controlled as a function of the amplitude of the pre-ignition phenomenon.

33 Claims, 6 Drawing Sheets

METHOD FOR DETECTION OF ABNORMAL COMBUSTION FOR INTERNAL COMBUSTION ENGINES

BACKGROUND OF THE INVENTION

1. Field of the Invention

The present invention relates to combustion phase control of an internal combustion engine. In particular, the present invention is a method for detecting abnormal pre-ignition combustion at low rpm and at high load in a combustion chamber of an internal combustion engine. More specifically, but not exclusively, the invention is a method applied to a "downsized" spark-ignition engine functioning under very high loads.

2. Description of the Prior Art

This type of engine has at least one cylinder comprising a combustion chamber defined by the internal lateral wall of the cylinder, by the top of the piston that slides in this cylinder and by the cylinder head. Generally, a carbureted mixture is enclosed in this combustion chamber and is subjected to a compression step and then a combustion step under the effect of controlled ignition by a spark plug. These steps are collectively described by the term "combustion phase" in the following description.

It has been possible to confirm that this carbureted mixture can be subjected to different types of combustion and that these types of combustion are the source of different pressure levels, as well as mechanical and/or thermal stresses, of which some can seriously damage the engine.

The first combustion, called conventional combustion or normal combustion, is the result of the propagation of the combination of a carbureted mixture compressed by a prior engine compression step. This combustion propagates normally along a flame front starting from the spark generated by the spark plug and involves no risk of harming the engine.

Another type of combustion is combustion with "knocking", which results from undesirable self-ignition in the combustion chamber. Thus after the compression step of the carbureted mixture, the spark plug is actuated to allow ignition of the carbureted mixture. Due to the effect of the pressure generated by the piston and the heat released by the start of combustion of the carbureted mixture, forceful and localized auto-ignition of part of the compressed carbureted mixture occurs before the arrival of the flame front issued from the ignition of the carbureted mixture by the spark plug. Knocking leads to a local increase of the pressure and the temperature and can cause destructive effects on the engine and mainly at the piston, if repeated.

Finally, another type of combustion is abnormal combustion due to pre-ignition of the carbureted mixture before the spark plug initiates ignition of the carbureted mixture present in the combustion chamber.

This abnormal combustion affects engines resulting from an operation of "miniaturization," better known by the English term "downsizing." This operation tends to decrease the size and/or the cylinder of the engine while maintaining the same power and/or the same torque as conventional engines. Generally, this type of engines is mainly of the gasoline type and is highly supercharged.

It has been possible to confirm that this type of abnormal combustion occurs with high loads and generally during low rpm of the engine when the heat of combustion of the carbureted mixture is not optimum due to knocking. Taking into account the strong pressures and the elevated temperature reached in the combustion chamber by supercharging, starting of abnormal combustion can occur, sporadically or in a continuous manner, before the moment where the ignition of the carbureted mixture by the spark plug takes place. This combustion is characterized by a first phase of flame propagation that is timed too late in comparison to that of conventional combustion. This propagation phase can be interrupted by self-ignition which will involve a large majority of the carbureted mixture present in the combustion chamber which is much greater than that in the case of knocking.

In the case where this abnormal combustion is produced repetitively, from engine cycle to engine cycle, and occurs starting from a hot point of the cylinder, for example, it is called "pre-ignition." If this combustion occurs in a violent manner, randomly and sporadically, it is called "rumble" ("pre-ignition").

This latter abnormal combustion involves very elevated pressure levels (120 to 250 bars), as well as an increase of the thermal transfers that can involve partial or total destruction of the moving engine parts, like the pistons or the rods.

The general methodology for processing this type of abnormal combustion is diagrammed in FIG. 1. The first step is a prevention phase (PP) for limiting to a maximum the chances of appearance of the phenomenon. Then when prevention is not adequate to prevent the phenomenon, a detection phase (PD) is performed for determining whether or not there is a need to intervene in the cycle with a corrective phase (PC) when pre-ignition has been detected.

The detection phase (PD) comprises a signal acquisition phase followed by a signal processing phase making it possible to detect the appearance of pre-ignition at high load to describe and to quantify the pre-ignition at high load.

Patent Application EP 1,828,737 discloses a method for detecting the appearance of pre-ignition at high load of the "rumble" type. This method is based on the measurement of a signal relative to the progress of the combustion and a comparison to a signal threshold. The presence of an abnormal combustion of the "rumble" type in the combustion chamber is detected when the signal amplitude exceeds that of the signal threshold in a significant manner. According to this method, the signal threshold corresponds to the amplitude of the signal produced at the time of combustion with knocking or at the time of normal combustion.

However, according to this method, the detection thus implemented does not make it possible to act during the same cycle as the detection. The corrective actions of this type of pre-ignition are only implemented for the phenomenon that can seriously damage the integrity of the engine.

The method described in French Patent 2,897,900 makes possible more rapid action after detection of the pre-ignition. It is possible to act during the course of the same cycle as the detection cycle of the phenomenon. In order to do this, the signal threshold is calculated in advance, before the operation of the engine, and then is stored in calculator data tables known as maps.

However, the use of maps does not make it possible to detect, at any time, that is in real time, the start of such a phenomenon. Because of this fact, it is always possible that the detection may occur too late. In addition, no quantification of the trend of the pre-ignition can be implemented. Thus, the necessity to not to apply a correction action rests solely on the comparison of the two amplitudes at a given moment in time. Still, such a phenomenon can actually start, then stop, without involving damage to the engine and thus not require a corrective phase.

SUMMARY OF THE INVENTION

The invention is an alternative method for detecting, in real time, the appearance of a pre-ignition phenomenon at high load (of the rumble type), to characterize and to quantify it with devices and systems currently used in engines, in such a way as to take measures making possible prevention during the continuing engine function in the course of the same cycle as that of the detection. This detection and this quantification can be used at any crankshaft angle. The method is based on processing of a cylinder pressure measurement combined with modeling of the cylinder pressure.

The invention concerns a control method of the combustion of a supercharged internal combustion engine with controlled injection, in which abnormal combustion is detected in one combustion chamber 14 of at least one cylinder 12 of the engine, by a continuous pressure measurement $P_m(\alpha)$ within the cylinder. The method comprises the following steps:

a) choosing a physical model describing, as a function of the angle $\alpha$ of rotation of the crankshaft of the engine, development of the pressure in the cylinder during one combustion cycle without any pre-ignition;

b) estimating a cylinder pressure $P_e(\alpha)$, starting from the model and the measurement of intake pressure;

c) detecting a start of abnormal combustion detected by comparing at least one first value of a variable calculated using measurement of the cylinder pressure and at least one second value of the variable calculated using the estimation of the cylinder pressure;

d) determining an amplitude of pre-ignition by repeating steps b) and c) for a defined number of crankshaft angles; and e) controlling progress of the abnormal combustion detected in the combustion chamber according to the amplitude of the pre-ignition.

According to the invention, the physical model can describe the progression of the pressure in the cylinder as a function of the intake pressure and the combustion chamber volume of the cylinder.

It is possible to control the sequence of the abnormal combustion by introduction into the combustion chamber of an agent containing fuel, water, or carbon dioxide. It is also possible to control the sequence of the abnormal combustion by causing the pressure to drop in the interior of the combustion chamber 14. According to another embodiment, it is possible to control the sequence of the abnormal combustion by opening at least one additional valve to cause the pressure to drop in the interior of the combustion chamber 14. Finally, according to another embodiment, it is possible to control the sequence of the abnormal combustion by opening at least one of the valves 24, 30 to cause the pressure to drop on the inside of the combustion chamber 14.

According to the invention, the variable can be a cylinder pressure gradient. Then the start of abnormal combustion is detected by analyzing the sign of this gradient. It is also possible to choose the variable from among the following variables: a cylinder pressure gradient, an energy release, a cool gas temperature, or the logarithm of the cylinder pressure.

Finally, according to the invention, it is possible to compare several measured and estimated variables. This can be carried out by means of thresholds.

BRIEF DESCRIPTION OF THE DRAWINGS

The other characteristics and advantages of the invention will be seen from reading the description given below, referring to the attached drawings, in which:

FIGS. 6A and 6D illustrate the sensitivity of cool gas to pre-ignition wherein FIG. 6A represents the maximum energy release (DEM) as a function of CA10 for a temperature of intake air (measured in the plenum) of 30° C. in gray and a temperature of intake air (measured in the plenum) of 40° C. in black, (FIG. 6B) and a water temperature of 100° C. (FIG. 6C) with the circled zone on the graph representing a pre-ignition zone, FIG. 6D illustrates the connection between the water temperature and the temperature of cool gas with the curves representing the trend in the temperature of the cool gas (TGF) as a function of the crankshaft angle ($\alpha$) with the top curve corresponding to a water temperature of 100° C. and the lower one to a temperature of 80° C.

DETAILED DESCRIPTION OF THE INVENTION

Figure 1:
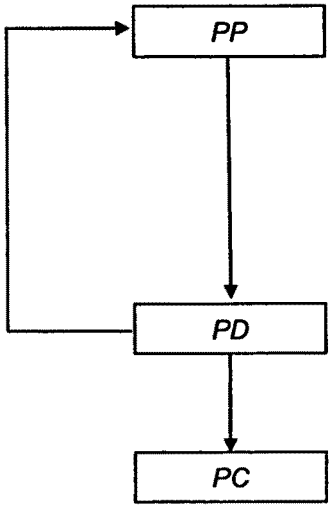
FIG. 1 shows the general methodology of processing abnormal combustions of the pre-ignition type.
Figure 2:
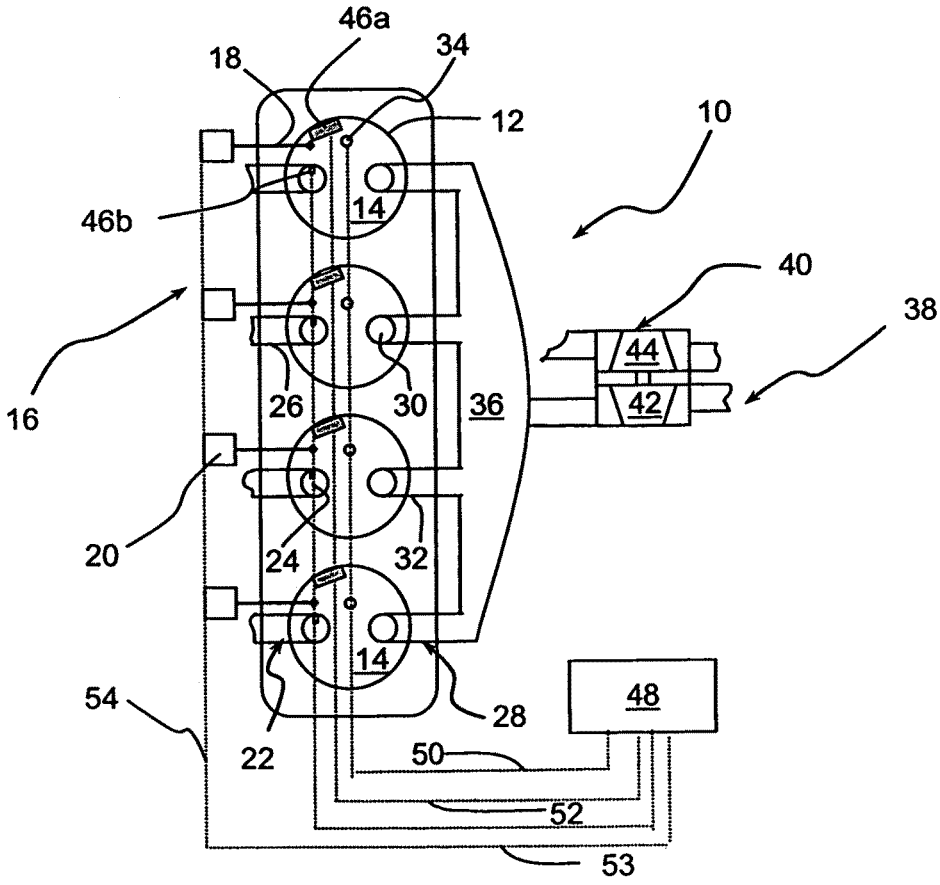
FIG. 2 shows an engine using the detection method according to the invention.

FIG. 2 illustrates a super charged internal combustion engine 10 supercharged with controlled ignition, in particular a gasoline type, comprising at least one cylinder 12 with a combustion chamber 14, in which combustion of a mixture of supercharged air and fuel occurs.

The cylinder comprises at least one means for supplying fuel under pressure 16, for example, a fuel injector 18 controlled by a slide valve 20 that opens into the combustion chamber, at least one means for intake of air 22 with a valve 24 combined with an intake pipe 26 ending at a plenum (not shown in the figure), at least one means for exhausting the burnt gas 28 with a valve 30 and an exhaust pipe 32 and at least one means for ignition 34, like a spark plug, which makes it possible to generate one or more sparks that make it possible to ignite the carbureted mixture present in the combustion chamber.

The pipes 32 of the exhaust means 28 of this engine are connected to an exhaust manifold 36, which itself is connected to an exhaust pipe 38. A supercharging device 40, for example a turbo compressor or a volumetric compressor, is placed on this exhaust pipe and comprises an actuation stage 42 with a turbine powered by exhaust gases circulating in the exhaust line and a compressor 44 that provides admission of intake air under pressure into the combustion chambers 14 by the intake pipes 26.

The engine comprises means 46*a* to measure the cylinder pressure which is located within the cylinder 12 of the engine. These measuring means are generally made up of a pressure sensor that makes it possible to generate a signal representative of the variation of the pressure in a cylinder.

The engine comprises means 46*b* for measuring the intake pressure which is located in plenum 26*b*. These measuring means are generally made up of an absolute pressure sensor, of the piezoelectric type, which generates a signal representative of the variation of the intake pressure in the intake plenum.

The engine also comprises a calculation and control unit 48, called an engine computer, which is connected by conductors (some of them bidirectional) to different elements and sensors of the engine in such a way as to be able to receive different signals emitted by these sensors, like the water temperature or the oil temperature, in order to process them by computing and then control the elements of this engine to ensure good operation.

Thus, in the case of the example shown in FIG. 2, the spark plugs 34 are connected by conductors 50 to the engine computer 48 to control the time of sparks igniting the carbureted mixture. The cylinder pressure sensor 46*a* is connected by a line 52 to the computer 48 to send signals thereto representative of the variation of the pressure in the cylinder and the control slide valves 20 of the injectors 18 are connected by conductors 54 to the computer 48 to control the injection of the fuel into the combustion chambers. Means 46*b* are also connected by a line 53 to the computer 48.

Within such an engine, the method according to the invention makes it possible to detect the appearance of a pre-ignition phenomenon at high load (of the rumble type), to describe and to quantify it. This detection and this quantification can be carried out at any crankshaft angle.

The method is based on a processing of a cylinder pressure measurement combined with a modeling of the cylinder pressure (signals emitted by the cylinder pressure sensor which are representative of the state of combustion). According to one embodiment, the method comprises the following steps:

1—the pressure in the cylinder is modeled;

2—the pressure in the cylinder is measured;

3—the start of abnormal combustion is detected by comparing the measured pressure cylinder to the modeled cylinder pressure; and 4—the progress of the abnormal combustion which is detected in the combustion chamber is controlled.

1—Modeling the Pressure in the Cylinder

The cylinder pressure in the course of the compression phase can be modeled for each of the engine cycles by using the hypothesis of polytropic compression:

$$PV^n = cte$$

where P is the pressure in the cylinder and V the volume of the combustion chamber of the cylinder. These two parameters naturally vary as a function of the rotation angle of the crankshaft $\alpha$.

The relationship between the volume of the combustion chamber and the angle of rotation of the crankshaft $\alpha$ is called the "law of engine volume" $V(\alpha)$. This law is a function of the geometric characteristics of the engine (stroke, cylinder bore, volumetric compression ratio and rod length). The dead volume Vm corresponds to the minimum volume of the chamber (at top dead center). It is noted that $V_{PMB}$ which is the volume of the combustion chamber at bottom dead center is the maximum volume that is reached two times in the combustion cycle (a first time at the end of the intake phase and a second time at the end of the pressure reduction phase).

By using this ratio for any crankshaft angle and the same ratio for the intake pressure $P_{adm}$ (moment at which bottom dead center is reached), it is possible to estimate the cylinder pressure $P_e(\alpha)$ during conventional combustion, that is without any pre-ignition phenomenon, using the following model:

$$P_e(\alpha) = P_{adm}\left(\frac{V_{PMB}}{V(\alpha)}\right)^n$$

The law of engine volume $V(\alpha)$ is known. The pressure during the intake phase is also known due to the means 46*b* for measuring the intake pressure. The exponent n, called the polytropic exponent, is also known. Thus it is possible to estimate a "theoretical" cylinder pressure which is the pressure that must be present in the cylinder if no pre-ignition has occurred throughout the compression.

It should be noted that the pressure during the intake phase theoretically corresponds to the pressure in the cylinder at the moment of intake of the carbureted mixture. This pressure is measured in the manifold. It is possible to replace this pressure by the pressure in the cylinder at the start of compression (that is at the end of intake), tuned on the absolute pressure measured at the intake in the manifold at the end of the intake phase (it is assumed that equilibrium is achieved at the end of the intake phase and at that moment: $P_{adm}=P$).

2—Pressure Measurement in the Cylinder

The measurement of the cylinder pressure $P_m(\alpha)$ is performed using means 46*a* for measuring the cylinder pressure. The instrumentation of the cylinders for a pressure measurement is more and more usual on vehicles.

3—Comparison of the Measured and Modeled Cylinder Pressures

To determine whether pre-ignition is in the course of occurring, the measured cylinder pressure $P_m(\alpha)$ is compared to the modeled cylinder pressure $P_e(\alpha)$. This comparison can thus be implemented at each crankshaft angle. This makes possible very rapid detection of the least deviation of the measured cylinder pressure in comparison to the theoretical cylinder pressure (modeled). By performing this comparison, over several crankshaft angles, it is possible to describe this deviation which can increase slowly, rapidly, stabilize, decrease, etc. As a function of the variation in this deviation, the pre-ignition is described and measured to decide what corrective actions are to be taken, or not.

Figure 3:
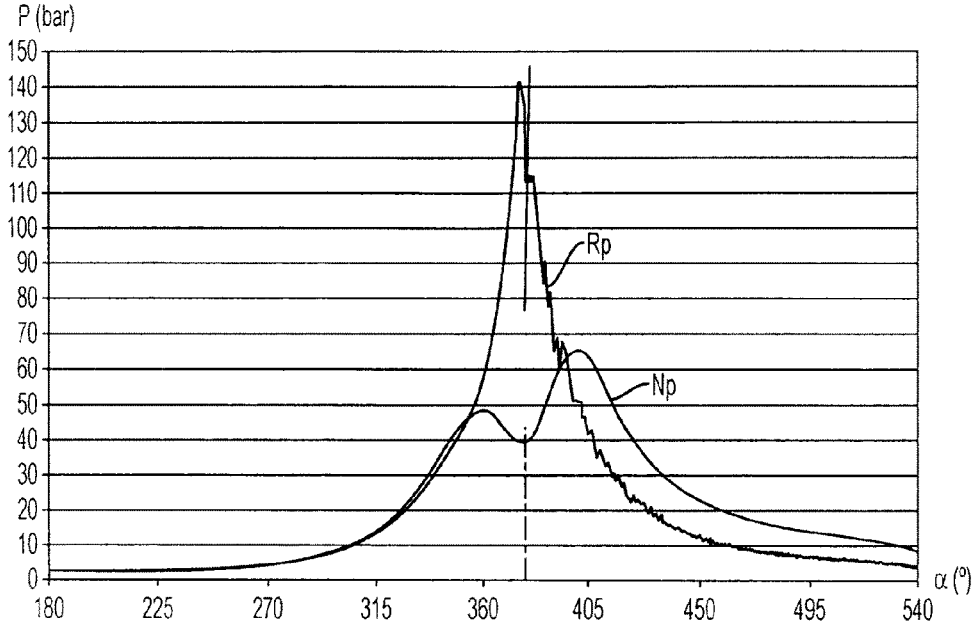
FIG. 3 shows, as a function of the crankshaft angle $\alpha$, a measured cylinder pressure curve ($R_P$) and a modeled cylinder pressure curve ($N_P$)

FIG. 3 shows a measured cylinder pressure curve ($R_P$), in black, and a modeled cylinder pressure curve ($N_P$) according to the model described above, which describes a cylinder pressure curve for conventional combustion. The abscissa indicates the crankshaft angle $\alpha$. The dotted vertical line indicates the moment at which the controlled ignition takes place. It can be confirmed that pre-ignition leads to excessive thermodynamic conditions risks the integrity of the engine at risk. However, it should be noted that the detection of a deviation between the measured and modeled cylinder pressures can be carried out very early on in the combustion cycle.

It is also possible to quantify these deviations in such a way as to determine at what time in the combustion cycle it is important to intervene.

In order to do this, it is possible to determine the thresholds, starting from a time at which rumble type pre-ignition is considered to be in the course of occurring and an indication that intervention is necessary.

For example, it is possible to define the following thresholds at each crankshaft angle an absolute cylinder pressure not to exceed $P_m(\alpha)<S_1$ a pressure deviation not to exceed $P_m(\alpha)-P_e(\alpha)<S_2$ a pressure ratio not to exceed $P_m(\alpha)/P_e(a)<S_3$ The thresholds $S_1$, $S_2$, and $S_3$ are defined before the engine operation as for example on the test bench.

According to an advantageous embodiment of the invention, these thresholds can evolve in the course of the engine operation. For example, it is possible to consider these thresholds to take account for the aging of the vehicle. Indeed, the fouling of the engine can be an aggravating factor with regard to the sensitivity of the engine to pre-ignition. According to the invention, this phenomenon is taken into account by arbitrarily setting the thresholds so they are more severe (for example by reducing the pressure limit) while regularly closely observing the behavior of the engine to periodically adjust these thresholds. The necessary adjustment level can be determined during the phase of tuning the engine by simulating accelerated aging of the engine, for example by inducing significant fouling with the use of a specific procedure. Generally an action is taken on the engine temperature, but also on the injection and ignition phases, to decrease the combustion and thus to generate carbon deposits on the walls of the combustion chamber identical to that which occurs during natural aging of the engine. Each experimenter is thus free to define the correspondence between an intentional accelerated aging and the natural aging of the engine involved. Finally, the previously set thresholds evolve in a manner that is inversely proportional to the aging of the vehicle, due to a correction coefficient K.

$$S' = S * K$$

$$\text{where } K\alpha \frac{1}{\text{odometer reading}}$$

$$\text{or even } K\alpha \frac{1}{\text{odometer reading}} \text{ for example}$$

The comparison of the two signals can naturally be carried out at several crankshaft angles. An early detection during the compression phase is preferable in any case, on one hand to maintaining a margin sufficient for intervening in the cycle and on the other, since the most violent pre-ignitions start at the time of this compression phase.

4—Control of Abnormal Combustion

By means of this comparison, the engine computer can detect the start of an abnormal combustion of the "rumble" type or of the "pre-ignition" type in the combustion chamber.

In the case of abnormal combustion, the computer then triggers the actions necessary to control this combustion in order to prevent the continuation of such combustion.

To control abnormal combustion, not only is it possible to manage the progress of combustion to prevent a serious increase in destructive pressure, but it is also possible to completely stop such combustion, such as by damping.

Preferably, the control of the combustion is implemented by a reinjection of the fuel at a crankshaft angle determined by the injectors 18. More specifically, the computer controls the slide valves 20 in such as a way that for the injector of the cylinder which is concerned it is possible to introduce into the combustion chamber a quantity of fuel in liquid form. The quantity of fuel reinjected depends on the make-up of the engine and can be from 10% to 200% of the quantity of fuel initially introduced into this combustion chamber. The reinjected fuel counters the flame that starts to deploy at the time of abnormal combustion. This reinjection makes it possible either to extinguish this flame or to damp the flame by increasing the richness of the carbureted mixture. Besides that, the injected fuel in liquid form uses the heat present around this flame to evaporate and the temperature conditions around the flame decrease while the combustion of the carbureted mixture and above all its auto-ignition is retarded.

After this injection of fuel, the pressure in the cylinder increases, but less forcefully. This pressure then decreases to achieve a level compatible with the pressure level of conventional combustion.

By using this mechanism, any development of abnormal combustion with high combustion speed and elevated pressure is prohibited. Naturally, the use of means for controlling abnormal combustion occurs at each cycle during which such combustion is detected by the computer.

The actions of the method as described above can be combined with other slower actions, such as closing the throttle valve to prevent the pressure conditions of the combustion chamber from being favorable for abnormal combustion in the following cycles.

The present invention is not limited to the implementation examples described above, but encompasses all variants and all equivalents.

In particular, and without departing from the scope of the invention, other agents for stopping abnormal combustion can be introduced into the combustion chamber. Thus these agents can be water in the form of vapor or liquid, or carbon dioxide. In this case, the engine comprises specific additional injectors for introduction of these agents in combination with a dedicated circuit (pump, tank, etc.).

It is also possible to envision controlling abnormal combustion by lowering the internal pressure of the combustion chamber by discharging pressure by opening a discharge valve. This discharge valve can be either an additional valve or the intake valve 24 and/or the exhaust valve 30.

In addition, the present invention can also concern a controlled-ignition engine with indirect injection. In this case, the control of the progress of abnormal combustion will be by the use of a specific injector (fuel, water, CO2) as mentioned above or by closing the valve.

Variants

Figure 4:
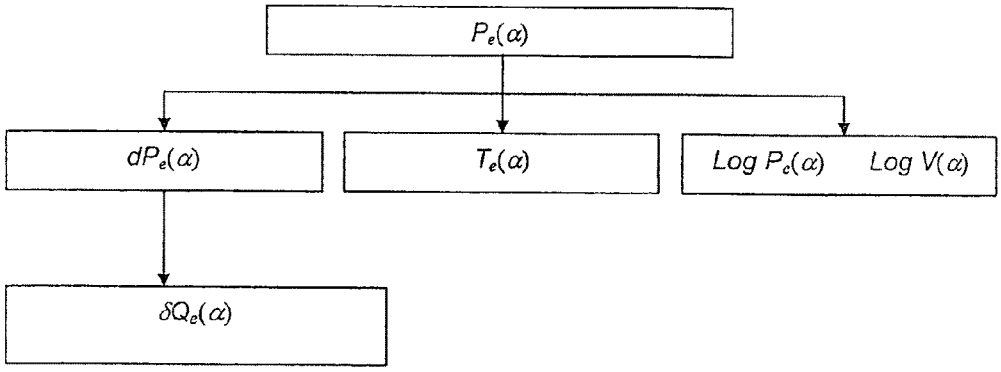
FIG. 4 illustrates the physical models used by the invention according to different embodiments resulting from the cylinder pressure.

An embodiment has been described that uses a model of cylinder pressure directly. According to other embodiments, it is possible to use derivative models (FIG. 4). Indeed, several signals can be used to detect the pre-ignition in real time, for example by working on: the gradient of the cylinder pressure, release of energy, the temperature of the cool gas, or even by working on the diagram log P/log V.

Figure 5:
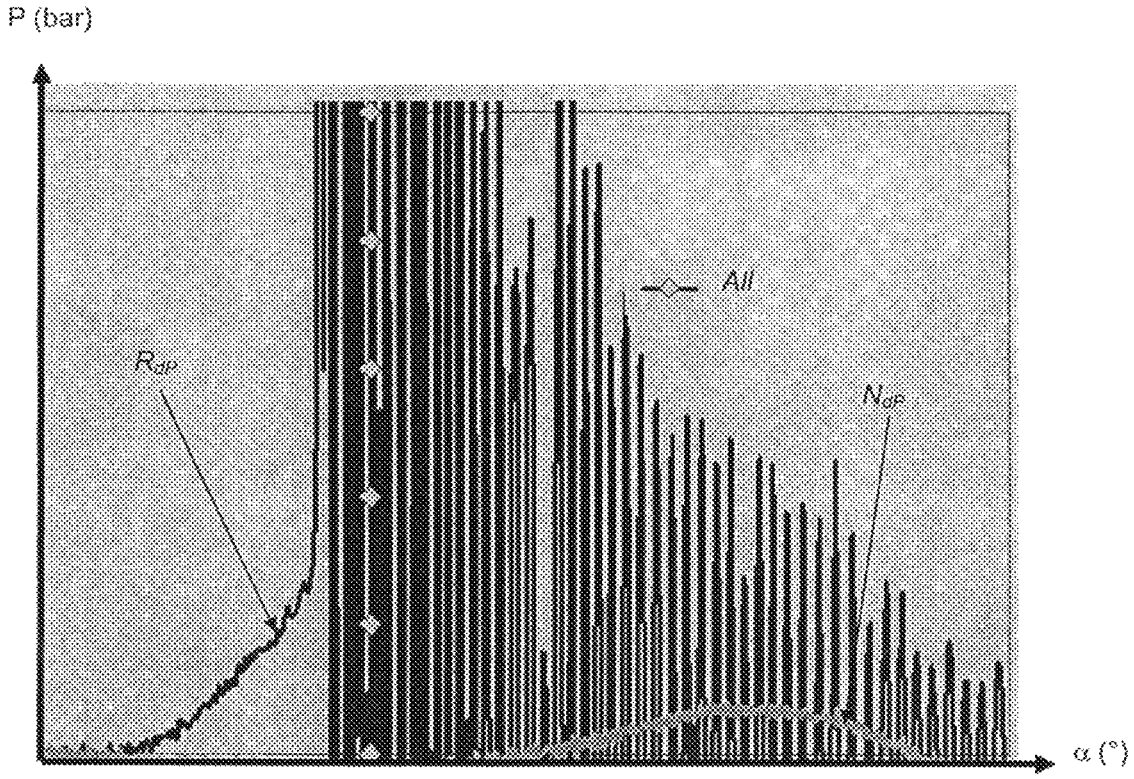
FIG. 5 shows, as a function of the crankshaft angle $\alpha$, a measured cylinder pressure gradient curve ($R_{dP}$) and a modeled cylinder pressure gradient curve ($N_{dP}$)

Cylinder Pressure Gradient (FIG. 5)

As a general rule, the conditions of appearance of pre-ignition (low engine rpm and high loads) occur when the ignition by the spark from the spark plugs is much more delayed during the pressure reduction phase in such a way as to prevent knocking. The cylinder pressure curve then shows the appearance of a first peak connected with the compression and a second offset peak connected with the combustion (FIG. 3). It is thus possible to detect the pre-ignition based solely on the sign of the cylinder pressure gradient. If the sign of the cylinder pressure is positive before the spark has been produced, it involves a pre-ignition.

In the same manner as for cylinder pressure, detection thresholds on the derivative of the cylinder pressure can also be defined at each crankshaft angle (the index "e" indicates an estimate and the index "m" a measurement):

an absolute pressure gradient not to exceed $dP_m(\alpha)<S_4$ a deviation not to exceed $dP_m(\alpha)-d\,P_e(\alpha)<S_5$ a ratio not to exceed $dP_m(a)/dP_e(a)<S_6$ Discharge of Energy The derivative of the cylinder pressure can also be used to calculate a simplified energy discharge SQ:

$$\left.\begin{array}{l} dU = \partial Q + \partial W \\ dU = m \cdot C_v \cdot dT \\ \partial W = -P \cdot dV \\ P \cdot V = m \cdot r \cdot T \\ r = C_p - C_v \\ s = \dfrac{C_p}{C_v} \end{array}\right\} \Rightarrow \partial Q = \frac{s}{s-1} P \cdot dV + \frac{1}{s-1} V \cdot dP$$

This simplified energy discharge can then also be used to define a threshold (the index "e" indicates an estimate and the index "m" a measurement)

by an absolute energy discharge not to exceed $\delta Q_m(\alpha) < S_7$ by an energy discharge deviation $\delta Q_m(\alpha) - \delta Q_e(\alpha) < S_8$ by an energy discharge ratio $\delta Q_m(\alpha)/\delta Q_e(\alpha) < S_9$ by calculating the advance indicators of the combustion, indicated CAX, and by comparing them to the same indicators calculated using the theoretical cylinder pressure evaluated by modeling. X designates the percentage of advance of the combustion. The angle CA10 corresponds, for example, to the angle where 10% of the energy introduced has been discharged or, according to the convention used, with 10% of the total energy released.

Temperature of the Cool Gas (FIGS. 6A-6D)

The average temperature of the cool gas T (air and fuel) is a parameter that presents the advantage of having a great influence on the sensitivity of the combustion at pre-ignition. Still, this temperature can be estimated using several other variables like temperature in the intake manifold (FIG. 6A), the quantities of air and of fuel admitted and the cylinder pressure. Thus it is possible to detect, even anticipate, a pre-ignition by placing a threshold at this temperature of the cool gas. Early detection of pre-ignition and good anticipation make it easy to provide more time for triggering a remedial action in the cycle itself.

Figure 6A:
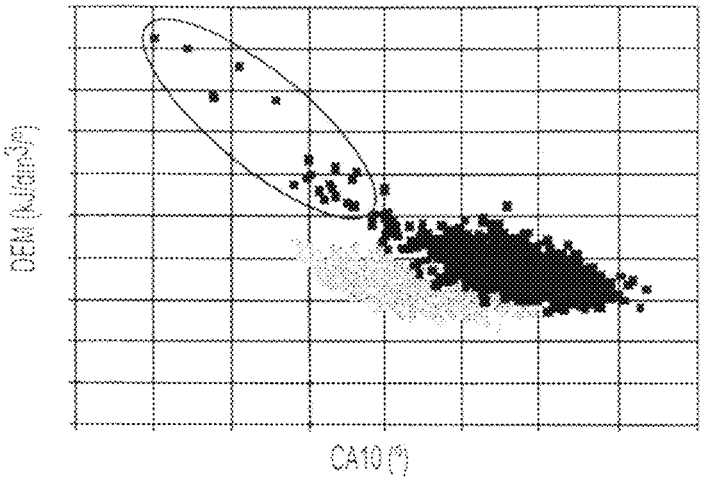

FIG. 6A represents the maximum energy release (DEM) as a function of CA10 for a temperature of the intake air (measured in the plenum) of 30° C. in gray and a temperature of the air intake (measured in the plenum) of 40° C. in black. The circled zone on this graph represents a zone of pre-ignition.

Figure 6B:
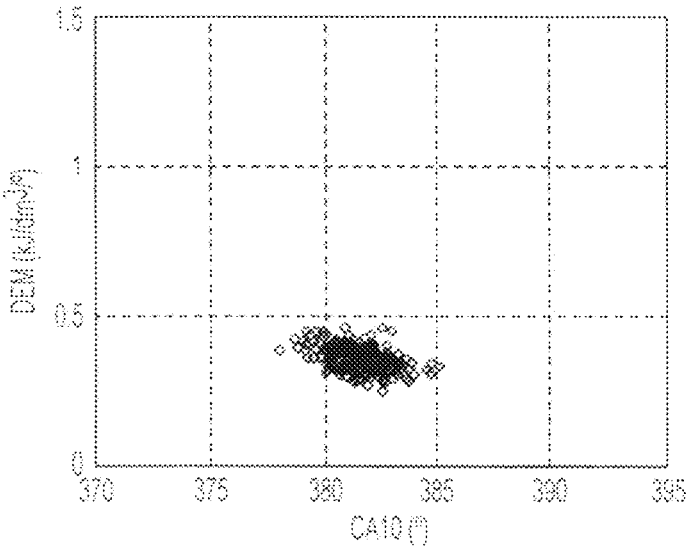
FIGS. 6B and 6C represent the maximum energy release (DEM) as a function of CA10 for a water temperature of 80° C.
Figure 6C:
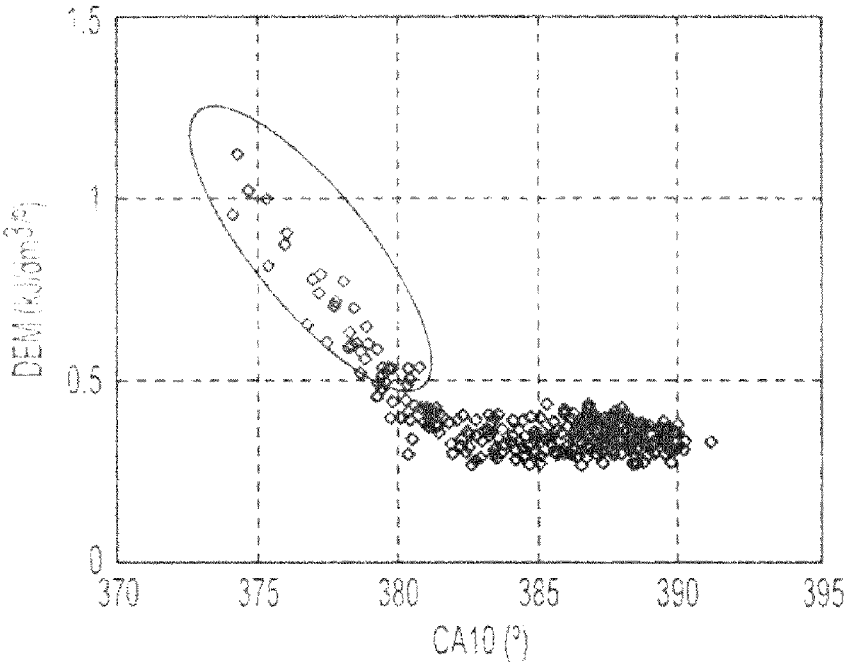

FIGS. 6B and 6C represent the maximum energy release (DEM) as a function of CA10 for a water temperature of 80° C. (FIG. 6B) and a water temperature of 100° C. (FIG. 6C). The circled zone on this graph represents a pre-ignition zone.

Figure 6D:
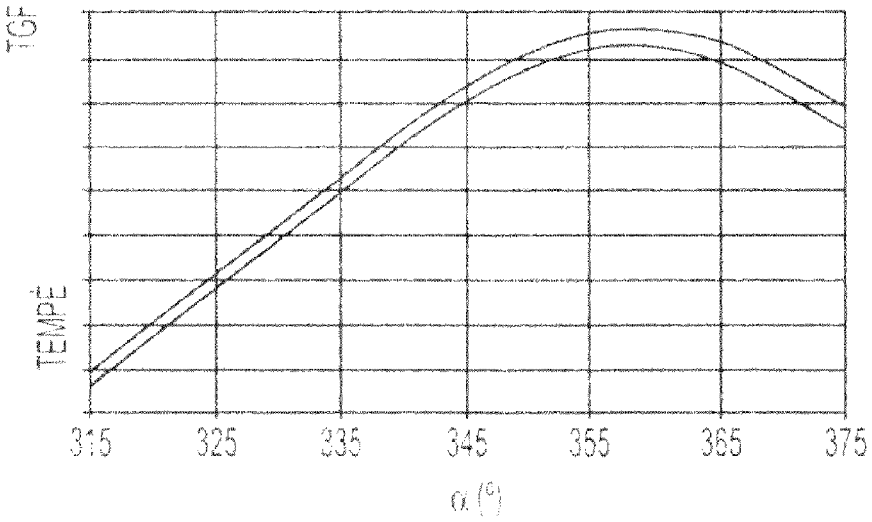

FIG. 6D illustrates the connection between the temperature of the water and the temperature of the cool gas. The curves represent the trend in the temperature of the cool gas (TGF) as a function of the crankshaft angle ($\alpha$). The top curve corresponds to a water temperature of 100° C. and the bottom one to a temperature of 80° C.

This average temperature of the cool gas $T_e(\alpha)$ can be calculated simply by using the perfect gas state equation:

$$P \cdot V = m \cdot r \cdot T \Rightarrow T_e(\alpha) = \frac{P_e(\alpha) \cdot V(\alpha)}{m \cdot r}$$

The mass of the mixture m may be known from the engine or by direct measurement using a flow meter or by models that evaluate, in real time, the air feed entering using pressure measurements of the intake line.

Figure 7:
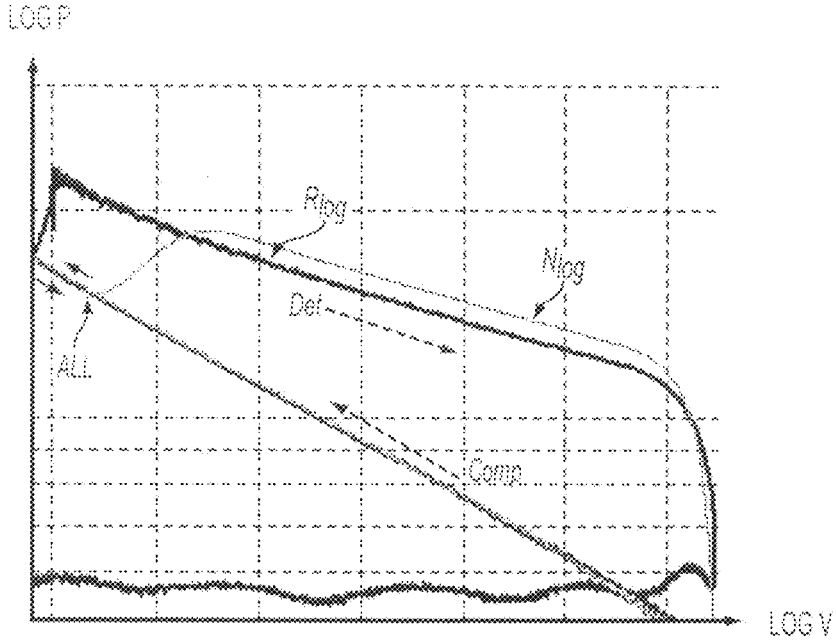
FIG. 7 represents the trend of log(P) as a function of log(V) in a case of pre-ignition (black curve, $N_{log}$) and according to a model of a conventional combustion without pre-ignition (gray curve, $R_{log}$).

The detection threshold of the temperature can also be defined in three ways at a given crankshaft angle (the index "e" indicates an estimate and the index "m" a measurement):

by an absolute temperature not to be exceeded $T_m(\alpha) < S_{10}$ by a temperature range $T_m(\alpha) - T_e(\alpha) < S_{11}$ by a temperature ratio $T_m(\alpha)/T_e(\alpha) < S_{12}$ Diagram Log P/Log V (FIG. 7)

The variables log(P) and log(V) offer the advantage of simplifying the representation of the trend in the cylinder pressure in the course of the engine cycle.

$$PV^n = cte$$

$$\Rightarrow \log P + n \cdot \log V = cte$$

$$\Rightarrow \log P = cte - n \cdot \log V$$

FIG. 7 represents the trend of log(P) as a function of log(V) in a case of pre-ignition (black curve, $N_{log}$) and according to a modeling of the conventional combustion without pre-ignition (gray curve, $R_{log}$).

The advantage of this representation is in the exploitation of the linearity that connects log P and log V. Indeed, this linearity makes it possible to gain predictive capacity since the slope followed by the compression (Comp) up to PMH can be known from the initial instant of this compression. Thus it is possible to model the theoretical pressure by calculating the slope n using the measurements performed at the start of compression.

In addition, this method makes it possible to detect not only the pre-ignitions that occur during compression, but also those that occur during pressure reduction (Def) since this linear relationship also exists during pressure reduction. In the case of an ignition (All) at the spark plug offset during the pressure reduction, it is thus possible to predict the path that the cylinder pressure must follow up to this ignition.

It should be noted, the ignition at the spark plug is a very high load that must be offset during the pressure reduction to prevent the appearance of knocking. While negative in terms of yield, this offset is very effective for preventing knocking. There a cylinder pressure curve with two peaks is found: a first peak corresponding to the pure compression of the mixture and a second peak corresponding to the increase in pressure generated by the combustion (FIG. 3). Under these conditions, the pre-ignition is triggered either during compression (the most critical cases) or during the pressure reduction after the first peak of compression.

The threshold can then be defined by a deviation between the curve representing the log of the measured cylinder pressure and the curve representing the theoretical cylinder pressure (modeled):

by an absolute term log(P) not to exceed $\log P_m(\alpha) < S_{13}$ by a deviation not to exceed $\log P_m(\alpha) - \log_{Pe}(\alpha) < S_{14}$ by a ratio not to exceed $\log P_m(\alpha)/\log P_e(\alpha) < S_{15}$ According to one embodiment, for all the ratios between an experimental variable and a modeled variable, in particular those that have the risk of canceling each other, the ratio is made less unstable, by regularizing the expression with one or several constant terms (in this case $P0_m$ and $P0_e$), avoiding the cancellation or the calculation and also making it possible to compensate a strict non-linearity among the variables. For example:

$$\log(P_m(\alpha) + P_m^0)/(P_e(\alpha) + P_e^0) < S_{15}$$

These terms are determined a priori as a function of the expected variable.

In an advantageous manner a variable is not used, but rather a combination of variables, for example P and V.

Finally, in order to limit the impact of the localized fluctuations, it is interesting to carry out comparisons with the thresholds, not only with the variable recorded at an angle $\alpha$, but with estimations of these variables at a certain angular range (small or on the same order as the minimum duration necessary to estimate the passing of a threshold). If three angular measurements are taken in succession, P(−1) P(0)P (+1) for example, an estimation of P at point 0 can be obtained by taking the average of [P(−1) P(0)P(+1)], their median value, their maximum or any combination with a weighting of these values. This is useful for the calculation of the derivative, for example. This calculation can be carried out in a recursive manner, that is by reusing at point 0 the preceding measurement at point −1 in [P(−2) P(−1) P(0)].

Application

Thus, at the time the engine function as described in relationship with FIG. 2, the means for measuring cylinder pressure 46*a* records the variation in this pressure within cylinder 12. This information is sent in the form of a signal by line 52 to the engine computer 48. This computer estimates, for example at each crankshaft angle, the cylinder pressure by means of a physical model and compares the modeled and measured cylinder pressures using the threshold values, for example. This comparison allows the engine computer to determine the presence of the start of abnormal combustion of the rumble type in the combustion chamber. The engine computer then sends the instructions for control using the fuel feed under pressure 16 by way of the conductors 54 to modify the injection parameters in a manner such that this abnormal combustion of the rumble type is not reproduced during the following cycles.

Thus, according to the invention, the detection of pre-ignition takes place starting from its initiation in such a way as to be able to quantify and define its progress in real time. The detection can be carried out for any crankshaft angle of each engine cycle. The detection thus takes place well before the pre-ignition leads to thermodynamic conditions that are critical for harming the integrity of the engine. The invention thus makes it possible, on one hand, to judge whether this pre-ignition is critical for harming the engine and on the other, to act in the same cycle as the detection to eliminate or decrease it. The detection is based on a comparison of signals connected to the cylinder pressure with the modeled signals corresponding to the values obtained for these same signals in the case of conventional combustion, that is without appearance of pre-ignition, and does so for each crankshaft angle of each engine cycle, thus making possible an extremely precise detection of the phenomenon, a quantification, and a rapid action to control the phenomenon.

The invention claimed is:

1. A method for controlling combustion of a supercharged internal combustion engine with controlled ignition, in which abnormal combustion is detected in a combustion chamber of at least one cylinder of the engine by a continuous measurement of pressure inside the at least one cylinder, comprising:

a) using a computer to estimate cylinder pressure with a physical model describing, as a function of an angle of rotation of a crankshaft of the engine, development of pressure in the at least one cylinder during one combustion without any pre-ignition;

b) estimating a cylinder pressure, starting from the model and the measurement of intake pressure to the at least one cylinder;

c) detecting a start of the abnormal combustion by comparing at least one first value of a variable calculated using measurement of the pressure in the at least one cylinder and at least one second value of the variable calculated using an estimation of the pressure in the at least one cylinder;

d) determining an amplitude of pre-ignition by repeating steps b) and c) for a number of crankshaft angles; and e) controlling progress of the abnormal combustion detected in the combustion chamber according to the amplitude of the pre-ignition.

2. A method according to claim 1, wherein:

the physical model describes a variation in pressure in the at least one cylinder as a function of the intake pressure and volume of the at least one cylinder.

3. A method according to claim 1, wherein:

progress of the abnormal combustion is controlled by introducing into the combustion chamber an agent containing one of fuel, water, or carbon dioxide.

4. A method according to claim 2, wherein:

progress of the abnormal combustion is controlled by introducing into the combustion chamber an agent containing one of fuel, water, or carbon dioxide.

5. A method according to claim 1, wherein:

progress of the abnormal combustion is controlled by causing pressure to drop in the at least one cylinder.

6. A method according to claim 2, wherein:

progress of the abnormal combustion is controlled by causing pressure to drop in the at least one cylinder.

7. A method according to claim 1, wherein:

progress of the abnormal combustion is controlled by opening at least one additional valve causing pressure to drop in the at least one chamber.

8. A method according to claim 2, wherein:

progress of the abnormal combustion is controlled by opening at least one additional valve causing pressure to drop in the at least one chamber.

9. A method according to claim 1, wherein:

progress of the abnormal combustion is controlled by opening at least one additional valve causing pressure to drop in the at least one chamber.

10. A method according to claim 2, wherein:

progress of the abnormal combustion is controlled by opening at least one additional valve causing pressure to drop in the at least one chamber.

11. A method according to claim 1, wherein:

the variable is a cylinder pressure gradient and in which a start of abnormal combustion is detected by analyzing a sign of the gradient.

12. A method according to claim 2, wherein:

the variable is a cylinder pressure gradient and in which a start of abnormal combustion is detected by analyzing a sign of the gradient.

13. A method according to claim 3, wherein:

the variable is a cylinder pressure gradient and in which a start of abnormal combustion is detected by analyzing a sign of the gradient.

14. A method according to claim 4, wherein:

the variable is a cylinder pressure gradient and in which a start of abnormal combustion is detected by analyzing a sign of the gradient.

15. A method according to claim 5, wherein:

the variable is a cylinder pressure gradient and in which a start of abnormal combustion is detected by analyzing a sign of the gradient.

16. A method according to claim 6, wherein:

the variable is a cylinder pressure gradient and in which a start of abnormal combustion is detected by analyzing a sign of the gradient.

17. A method according to claim 7, wherein:

the variable is a cylinder pressure gradient and in which a start of abnormal combustion is detected by analyzing a sign of the gradient.

18. A method according to claim 8, wherein:
the variable is a cylinder pressure gradient and in which a start of abnormal combustion is detected by analyzing a sign of the gradient.

19. A method according to claim 9, wherein:
the variable is a cylinder pressure gradient and in which a start of abnormal combustion is detected by analyzing a sign of the gradient.

20. A method according to claim 10, wherein:
the variable is a cylinder pressure gradient and in which a start of abnormal combustion is detected by analyzing a sign of the gradient.

21. A method according to claim 1, wherein:
the variable is chosen from among the following variables: cylinder pressure gradient, energy release, temperature of cool gas, and a logarithm of the cylinder pressure.

22. A method according to claim 2, wherein:
the variable is chosen from among the following variables: cylinder pressure gradient, energy release, temperature of cool gas, and a logarithm of the cylinder pressure.

23. A method according to claim 3, wherein:
the variable is chosen from among the following variables: cylinder pressure gradient, energy release, temperature of cool gas, and a logarithm of the cylinder pressure.

24. A method according to claim 4, wherein:
the variable is chosen from among the following variables: cylinder pressure gradient, energy release, temperature of cool gas, and a logarithm of the cylinder pressure.

25. A method according to claim 5, wherein:
the variable is chosen from among the following variables: cylinder pressure gradient, energy release, temperature of cool gas, and a logarithm of the cylinder pressure.

26. A method according to claim 6, wherein:
the variable is chosen from among the following variables: cylinder pressure gradient, energy release, temperature of cool gas, and a logarithm of the cylinder pressure.

27. A method according to claim 7, wherein:
the variable is chosen from among the following variables: cylinder pressure gradient, energy release, temperature of cool gas, and a logarithm of the cylinder pressure.

28. A method according to claim 8, wherein:
the variable is chosen from among the following variables: cylinder pressure gradient, energy release, temperature of cool gas, and a logarithm of the cylinder pressure.

29. A method according to claim 9, wherein:
the variable is chosen from among the following variables: cylinder pressure gradient, energy release, temperature of cool gas, and a logarithm of the cylinder pressure.

30. A method according to claim 10, wherein:
the variable is chosen from among the following variables: cylinder pressure gradient, energy release, temperature of cool gas, and a logarithm of the cylinder pressure.

31. A method according to claim 11, wherein:
the variable is chosen from among the following variables: cylinder pressure gradient, energy release, temperature of cool gas, and a logarithm of the cylinder pressure.

32. A method according to claim 1, wherein:
the measured and the estimated variables are compared.

33. A method according to claim 32, wherein:
the measured and the estimated variables are compared using thresholds.

* * * * *